US005088708A

United States Patent [19]

Nowak

[11] Patent Number: 5,088,708

[45] Date of Patent: Feb. 18, 1992

[54] FOLDING CYLINDER ASSEMBLY HAVING ONE PIECE CAM

[75] Inventor: Brent M. T. Nowak, Seabrook, Tex.

[73] Assignee: Rockwell International Corporation, El Segundo, Calif.

[21] Appl. No.: 622,896

[22] Filed: Dec. 5, 1990

[51] Int. Cl.[5] ..... B42C 1/00

[52] U.S. Cl. ..... 270/47; 270/48; 270/50; 493/424; 493/427; 493/432

[58] Field of Search ..... 270/47, 48, 49, 50, 270/21.1, 42, 60; 493/424–435

[56] References Cited

U.S. PATENT DOCUMENTS

| | | | |
|---|---|---|---|
| 3,038,719 | 6/1962 | Tyma | 270/50 |
| 3,460,823 | 8/1969 | Neal | 270/47 |
| 4,445,881 | 5/1984 | Bullen | 270/50 |
| 4,778,166 | 10/1988 | Nanba | 270/47 |
| 4,822,328 | 4/1989 | Bertolini | 493/425 |

FOREIGN PATENT DOCUMENTS

| | | | |
|---|---|---|---|
| 2714915 | 10/1978 | Fed. Rep. of Germany | 270/47 |
| 386004 | 1/1933 | United Kingdom | 270/50 |

*Primary Examiner*—John T. Kwon
*Assistant Examiner*—Therese M. Newholm
*Attorney, Agent, or Firm*—C. B. Patti; V. L. Sewell; H. F. Hamann

[57] ABSTRACT

The folding cylinder assembly has: rotatable folding cylinder having three pin lever shaft assemblies spaced substantially equally about the folding cylinder, each of the pin lever shaft assemblies having at least one pin and a cam follower positioned on a first end of the folding cylinder; one piece cam for interfacing with the cam followers, the one piece cam rotationally mounted on the first end of the folding cylinder, the one piece cam having two lobes which periodically contact the cam followers as the cam rotates; mechanism for rotating the folding cylinder and the cam such that the cam and the folding cylinder have a first relative angular velocity for the first mode of operation and second relative velocity for the second mode of operation, wherein in the first mode of operation the folding cylinder rotates at a substantially constant angular velocity and the cam rotates at one and one-half times the substantially constant angular velocity in the same direction of rotation as the folding cylinder, and wherein in the second mode of operation the folding cylinder rotates at the substantially constant angular velocity and the cam rotates at three-quarters of the substantially constant angular velocity in the same direction of rotation as the folding cylinder. The rotation of the cam imparting to each of the pins on the pin lever shaft assemblies via the cam followers, respectively, a predetermined motion profile in both the first and second modes of operation. The predetermined motion profile is a modified sine-harmonic motion profile in a preferred embodiment.

13 Claims, 19 Drawing Sheets

A RELEASES-1 COPY
B OBTAINS-1 COPY
C NO COPY

A NO COPY
B RELEASES-1 COPY
C OBTAINS-1 COPY

A OBTAINS-1 COPY
B NO COPY
C RELEASES-1 COPY

A RELEASES-1 COPY
B OBTAINS-1 COPY
C NO COPY

A RELEASES-2 COPIES
B OBTAINS-1st COPY
C RETAINS-1st COPY

A NO COPIES
B RETAINS-1st COPY
C OBTAINS-2nd COPY

A OBTAINS-1st COPY
B RETAINS-1st COPY
C RELEASES-2 COPIES

A RETAINS-1st COPY
B OBTAINS-2nd COPY
C NO COPIES

A RETAINS-1st COPY
B RELEASES-2 COPIES
C OBTAINS-1st COPY

A OBTAINS-2nd COPY
B NO COPIES
C RETAINS-1st COPY

A RELEASES-2 COPIES
B OBTAINS-1st COPY
C RETAINS-1st COPY

FOLDING CYLINDER ASSEMBLY HAVING ONE PIECE CAM

BACKGROUND OF THE INVENTION

The present invention relates in general to folders used in printing presses and, more particularly, to a folding cylinder assembly for use in a folder.

A number of folders are known in the prior art, one of which is referred to as a 3:2 folder. Such a folder is disclosed in U.S. Pat. No. 4,635,915 (herein incorporated by reference). This disclosure depicts a folding cylinder employed in a folder which introduces webs laid one over another between the folding cylinder and cutting cylinder which are disposed side by side and rotate in opposite directions to each other, cuts the webs in a section of the printed papers by cutting the webs by bringing the cutting knife in the cutting cylinder into engagement with the knife receiving member in the folding cylinder, and then folds the section of the printed papers. In what is referred to as a Collect run an inside section of the printed papers is held temporarily by pins in the folding cylinder so that the inside section wraps around the circumference of the folding cylinder and waits for an outside section of the printed papers. The outside section of the printed papers is superposed on the inside section of the printed papers and cut after the folding cylinder is rotated by a full turn, and then the superposed sections are folded together.

U.S. Pat. No. 4,635,915 discloses one type of folding cylinder and is hereby incorporated by reference as depicting the general structure and operation of one example of a prior art folding cylinder.

A number of folding cylinder designs are known in the prior art. Typically, they use a rotating cam, which in turn drives a swinging roller follower, which is connected to a shaft which drives eight parallel slider crank mechanisms. In one system a cam system uses a plate cam, in contrast, to a box cam used in other systems, (also known as the closed-track cam). The plate cam requires a spring load to maintain the swinging roller follower in contact with the cam surface. The system known as a 160 page 3:2 uses a box cam as illustrated in FIGS. 1 and 2.

The folding cylinders of the prior art have several drawbacks. More precisely, the problem is two-fold, the cams' operating environment is contaminated, and the cam loading is excessive.

A detrimental by-product of the newspaper folding process is paper dust. Paper dust is generated as the streams of newsprint are directed through the machine. More accurately, the paper is turned, folded, twisted, combined, compressed, cut, and folded again at linear velocities up to 30 mph.

Paper dust has the consistency of a fine saw dust. During a production run, this airborne contaminant is translucent. The contaminant becomes apparent as it settles, filling every inaccessible corner of the machine. This soft-to-the-touch dust is surprisingly destructive when combined with the latest lubrication system of the printing press.

The cam, the cam follower, and the cam gear are contained within a housing. This housing is descriptively named the 'folding cylinder cam housing'. The cam housing is considered a major intrusion region. A door exists in which operators are able to change cam segments. The cam segments are changed as the mode of operation changes.

The current design of the cam into four segments increases the cams loads. The resulting four seams never align perfectly in assembly, creating ridges, which in turn cause load spikes, known as jerk. Finally, previous cam acceleration profiles were less than optimally chosen.

The loss of effectiveness of the cam is defined as the degradation of the cam follower to track the desired motion profile program. Friction and wear cause this degradation. The effects of wear can be correlated with industry observations of the 160 page 3:2 folder cams, with about 5 years of service. Whenever two interlocking surfaces move with relative motion to each other, wear occurs.

The present invention significantly overcomes these drawbacks in the prior art.

SUMMARY OF THE INVENTION

It is an object of the present invention to provide an improved cam for use in a folder in a printing press system.

It is another object to provide a one piece cam useable in Straight and Collect modes of operation of the folder.

The folding cylinder assembly of the present invention has at least first and second modes of operation and comprises the following elements: rotatable folding cylinder having at least one pin lever shaft assembly, the pin lever shaft assembly having at least one pin and a cam follower positioned on a first end of the folding cylinder; one piece cam for interfacing with the cam follower, the one piece cam rotationally mounted on the first end of the folding cylinder, the one piece cam having at least one lobe which periodically contacts the cam follower as the cam rotates; and means for rotating the folding cylinder and the cam such that the cam and the folding cylinder have a first relative angular velocity for the first mode of operation and a second relative angular velocity for the second mode of operation.

In the first mode of operation the folding cylinder rotates at a substantially constant angular velocity and the cam rotates at one and one-half times the substantially constant angular velocity in the same direction of rotation as the folding cylinder. In the second mode of operation the folding cylinder rotates at the substantially constant angular velocity and the cam rotates at three-quarters of the substantially constant angular velocity in the same direction of rotation as the folding cylinder. The rotation of the cam imparts to the pins on the pin level shaft assembly via the cam follower a predetermined motion profile in both the first and second modes of operation. In a preferred embodiment the predetermined motion profile is a modified sine-harmonic motion profile and the cam is formed of high strength, flame hardened steel. Also, in a preferred embodiment the folding cylinder has three pin lever shaft assemblies spaced substantially equally about the folding cylinder, each of the cam followers of the pin lever shafts interfacing with the cam.

The term "one-piece" as used herein refers to the fact that the cam of the present invention can be operated in both modes without interchanging any sections of the cam. It is to be understood that for use of initial assembly or maintenance the "one-piece" cam of the present invention can be constructed of one or two or more segments.

BRIEF DESCRIPTION OF THE DRAWINGS

The features of the present invention which are believed to be novel, are set forth with particularity in the appended claims. The invention, together with further objects and advantages, may best be understood by reference to the following description taken in conjunction with the accompanying drawings, in the several Figures in which like reference numerals identify like elements, and in which:

DESCRIPTION OF THE PREFERRED EMBODIMENT

The present invention has general applicability but is most advantageously utilized in a folder known as a 3:2 folder. The detailed development of the present invention is disclosed in a thesis, "A Comparative Analysis And Design Of A New Printing Press Cam" by Brent Micheal Thomas Nowak, dated December, 1989 and is hereby incorporated by reference. The thesis sets forth a discussion of the method of analysis on pages 33-60, design goals and motion profiles on pages 81-88 and the inventive cam system on pages 97-101.

The application of the cam system of the present invention must be considered within the context of the machine in which it resides. This machine is commonly referred to as a 'folder'. It is the central machine in a series of printing presses, into which webs of newsprint flow. Within the folder the webs are layered on-top of each other in a predetermined fashion. The webs then receive their initial fold, travel through a series of rollers, and are directed into the folding cylinder and cutting cylinder assemblies. It is here that the newspaper receives its final fold, is cut from the web, and delivered to a receiving area.

Figure 1:
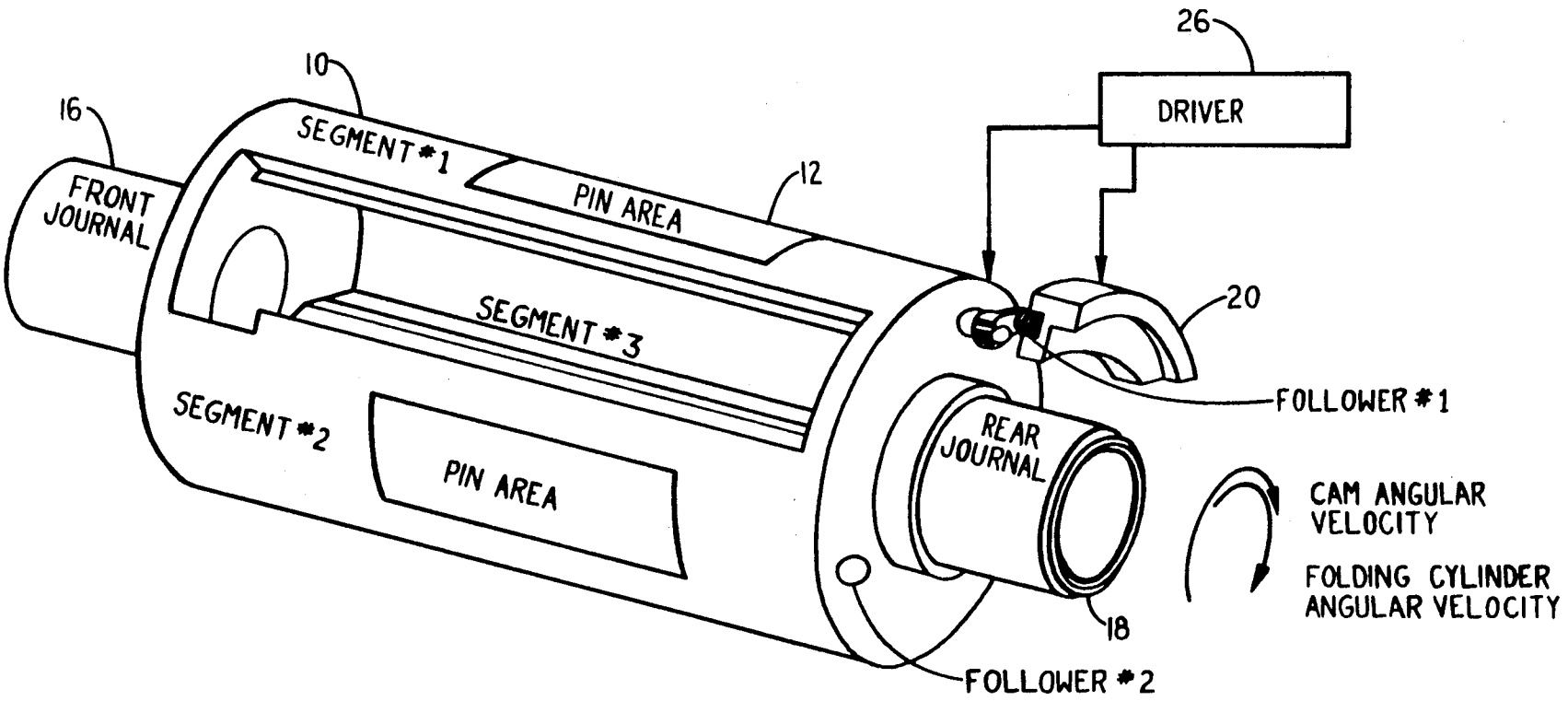
FIG. 1 is a schematic perspective view of a folding cylinder assembly used in the present invention.
Figure 4:
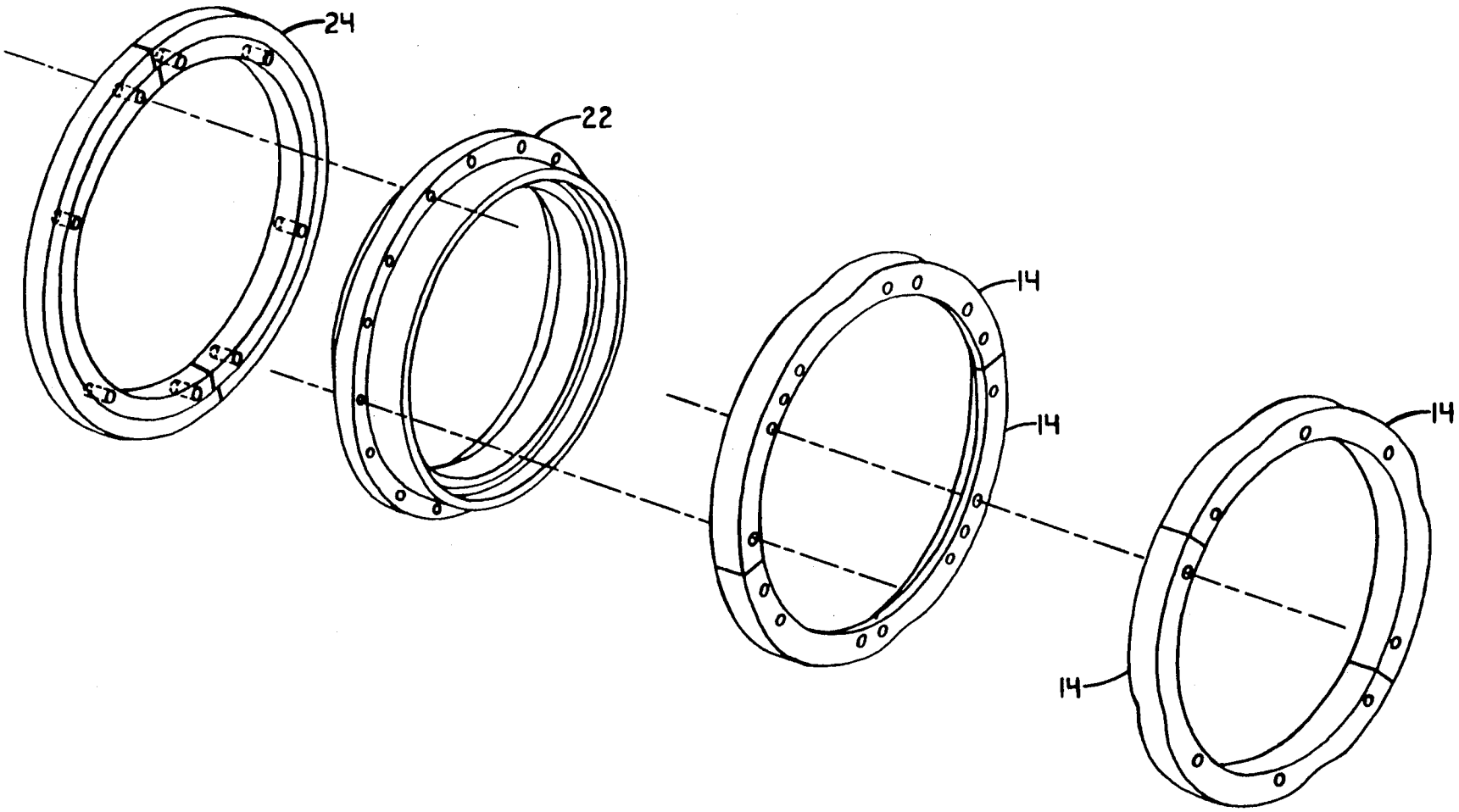
FIG. 4 is an exploded perspective view of a prior art cam used with the FIG. 1 folding cylinder assembly.

The folding cylinder assembly is shown in FIG. 1. It is comprised of the folding cylinder 10, three pin shaft assemblies 12, and four cam segments 14. The folding cylinder 10 is mounted on two journal bearings 16, 18. The cam 20 is mounted upon a cam bracket 22 and this bracket 22 is mounted on bearings 24 on the rear journal 18 of the folding cylinder 10, see FIG. 4. Both the folding cylinder 10 and the cam 20 are gear driven by means 26 (schematically shown in FIG. 1). Means for driving the folding cylinder 10 and the cam 20 are well known in the art. Each of these being driven in the same direction, yet, at a different constant angular velocity, which creates a constant relative angular velocity. For two revolutions of the folding cylinder 10, the cam 20 is required to rotate three revolutions, hence its name, 3:2.

Figure 2:
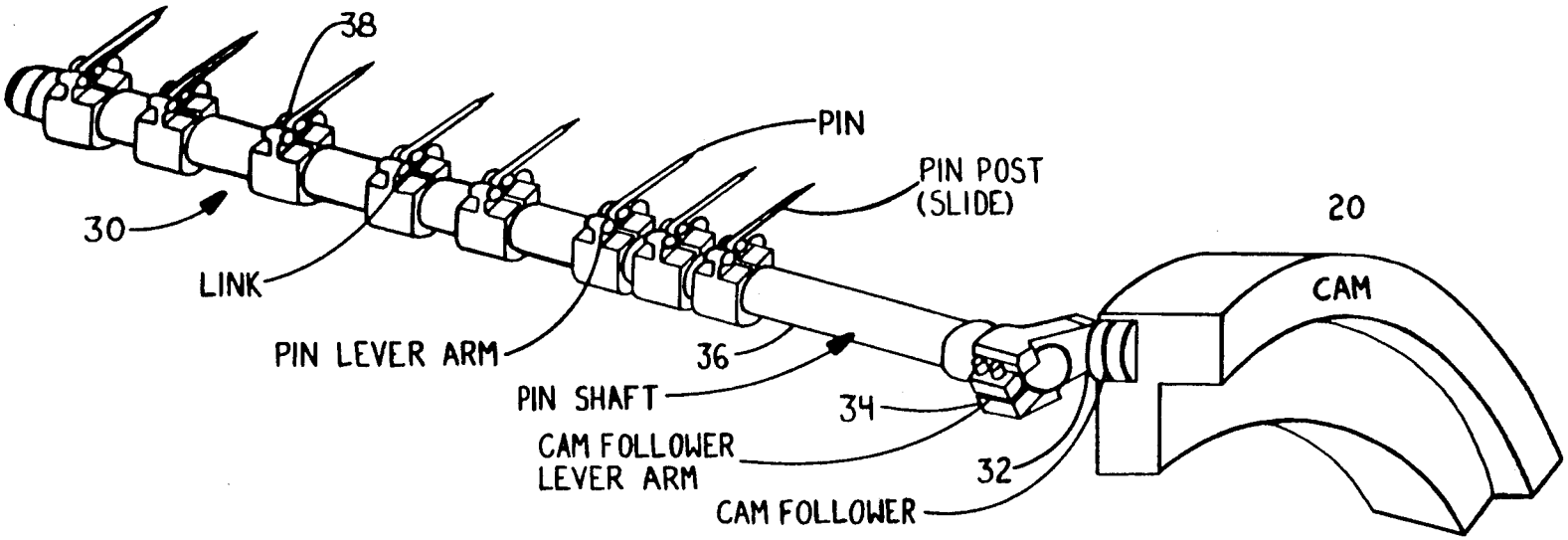
FIG. 2 is a schematic perspective view of pin lever shaft assembly used in the present invention.

The pin shaft assembly 30 is shown in FIG. 2. Each pin shaft assembly 30 is comprised of the cam follower 32, a cam follower lever arm 34, a pin shaft 36, and eight slider-crank mechanisms 38. The three pin shaft assemblies are mounted 120° apart within the folding cylinder. The pin shaft assemblies are mounted on three bearings, two end bearings and one center bearing (not shown).

Figure 3:
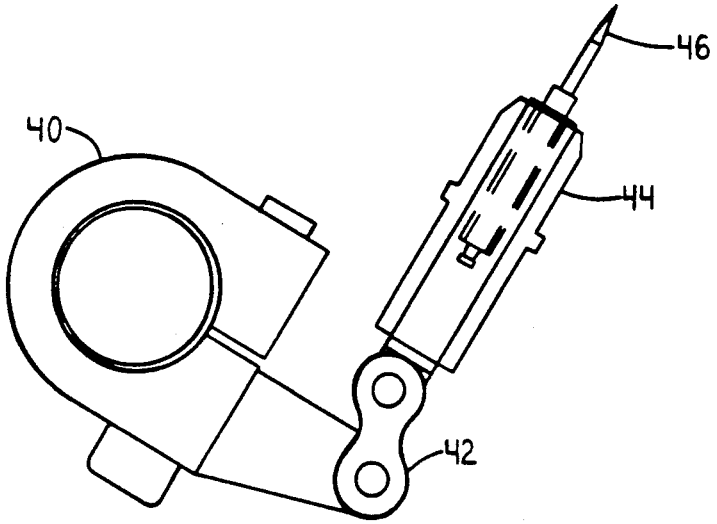
FIG. 3 is a plan view of a slider-crank mechanism used in the present invention.

The slider-crank mechanism 38 is shown in FIG. 3. Each is comprised of a cast steel, machined crank arm 40. The connecting link 42 is a heavy duty motorcycle link. The slide 44 is referred to as the pinpost. It is machined alloy steel with a screw insert pin 46.

There are two modes in which the folder may operate. These modes are determined by the operator prior to the beginning of a production run. These are called 'Straight' and 'Collect'. In the prior art the selection of the mode directly affects the number of lobes on the cam, which in turn affects the size of the newspaper product.

The Straight run requires two lobes, and the Collect run requires one lobe in prior art folders. Since the relative angular velocity is constant, changing the number of lobes is required to obtain different modes of operation.

The two modes are differentiated by observing what occurs after each pin shaft assembly passes from a six o'clock to an eight o'clock positions. In the Straight mode, as the first pin shaft assembly reaches the eight o'clock position, the cutting cylinder knives actuate. During this motion, a tucking blade moves out of the folding cylinder assembly at the mid-point of the newspaper, to tuck the product into a set of pinching rollers, for the final fold. Simultaneously, the slider-crank retracts to release the newspaper. In this manner, a single product is delivered. This occurs at every pass of the pin-shaft assemblies in a Straight run.

In the Collect mode the cutting/tucking/releasing process only occurs at every other pass of the pin shaft assembly. In prior art folders this is accomplished by removing one cam lobe, and replacing this lobe with a circular portion. This creates a cam with only one lobe, and for each revolution of the cam, only one newspaper is released.

A motion profile is the desired displacement curve that will occur during a rise or return in the motion of a component. A motion profile is selected for any one of several time dependent characteristics. Often the primary characteristic is the acceleration. The third derivative of the displacement is commonly known as jerk. The jerk is undesirable motion, yet is difficult to eliminate. Many designers resolve themselves to maintaining a finite jerk. The existence of large values of jerk will eliminate a motion program from high speed cam applications.

There are several different types of motion profiles. The most basic, yet rarely used in high speed applications, is the trapezoid motion profile. The trapezoid is comprised of a pair of isosceles trapezoids. This acceleration profile is composed of linear accelerations; this is achieved by using a cubic displacement profile in the first, third, fourth and sixth segments and a parabolic displacement profile in the second and fifth segments.

Other motion programs are the modified trapezoid motion profile, the modified sine profile, as well as the modified sine-harmonic profile of the present invention.

Figure 5:
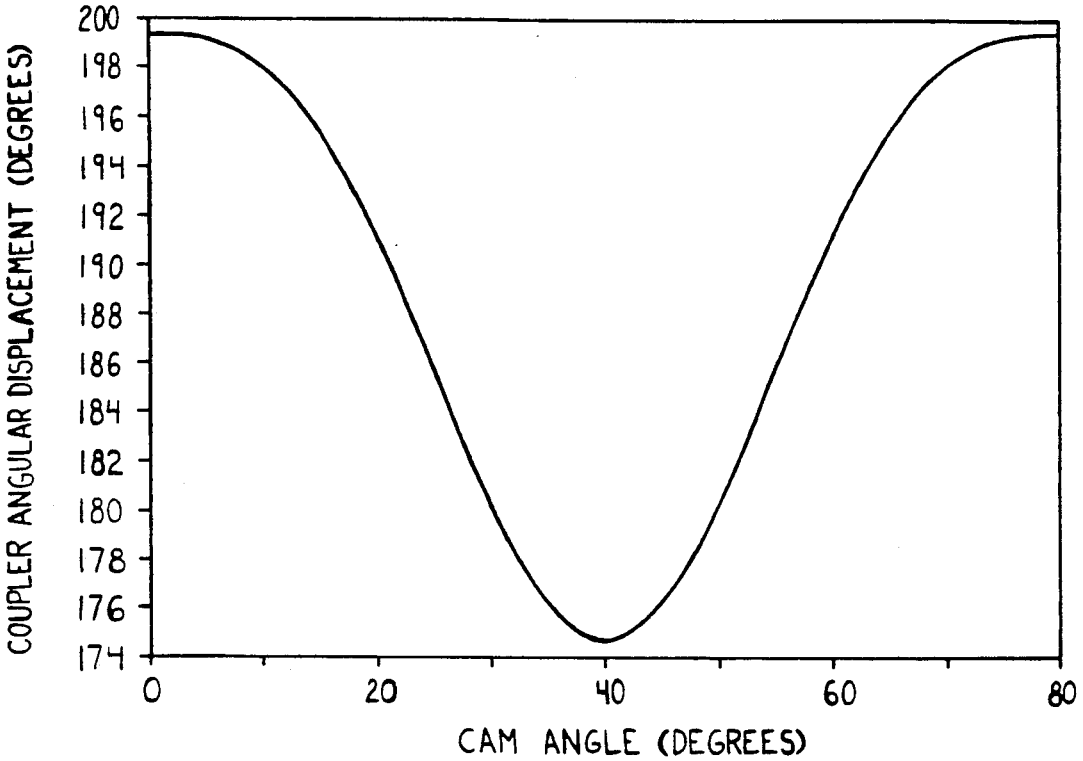
FIG. 5 is a graph of coupler angular displacement.

FIG. 5 represents coupler angular displacement, when the motion profile is input at the pin. This design process was used to develop the modified sine-harmonic motion profile, and the one piece cam of the present invention. As can be seen in the angular displacement graph, the motion takes on the symmetric, displacement shape of the input modified sine-harmonic profile.

Figure 6:
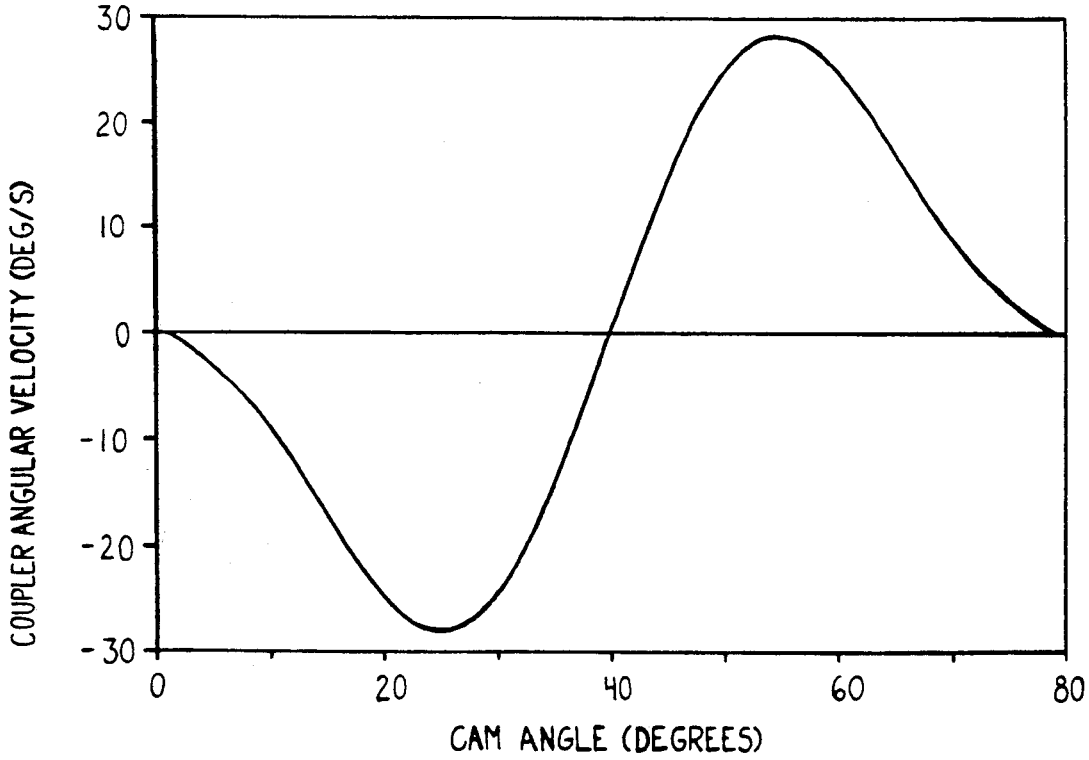
FIG. 6 is a graph of coupler angular velocity.
Figure 7:
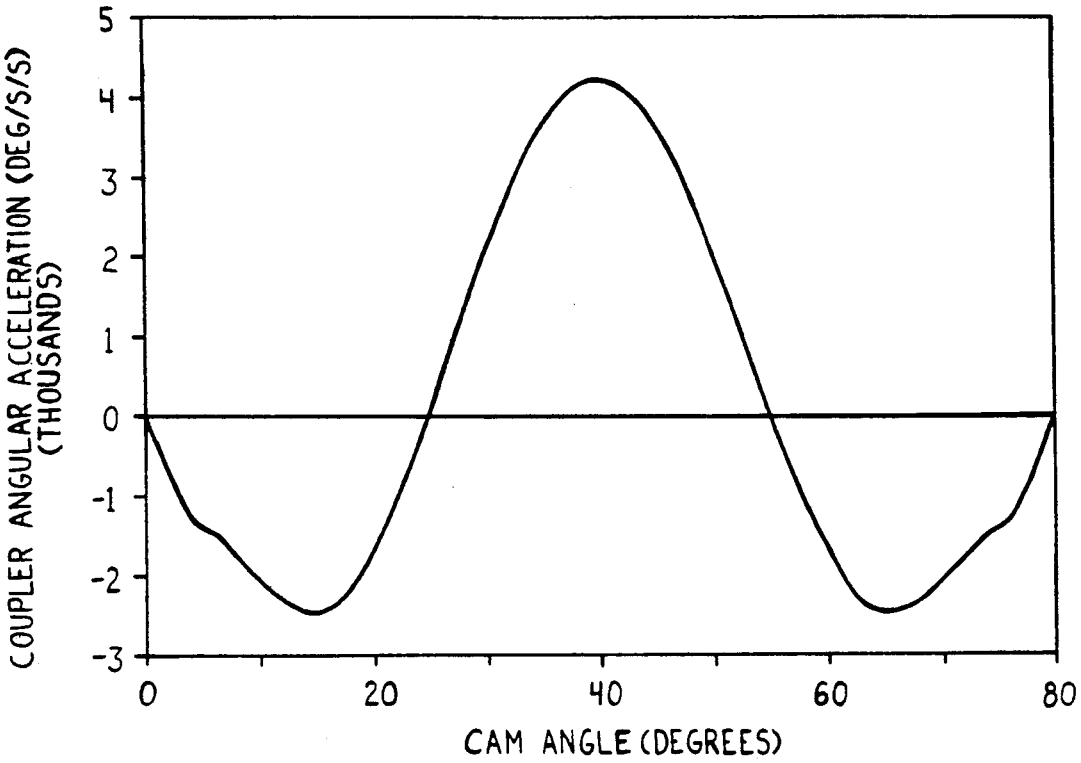
FIG. 7 is a graph of coupler angular acceleration.
Figure 8:
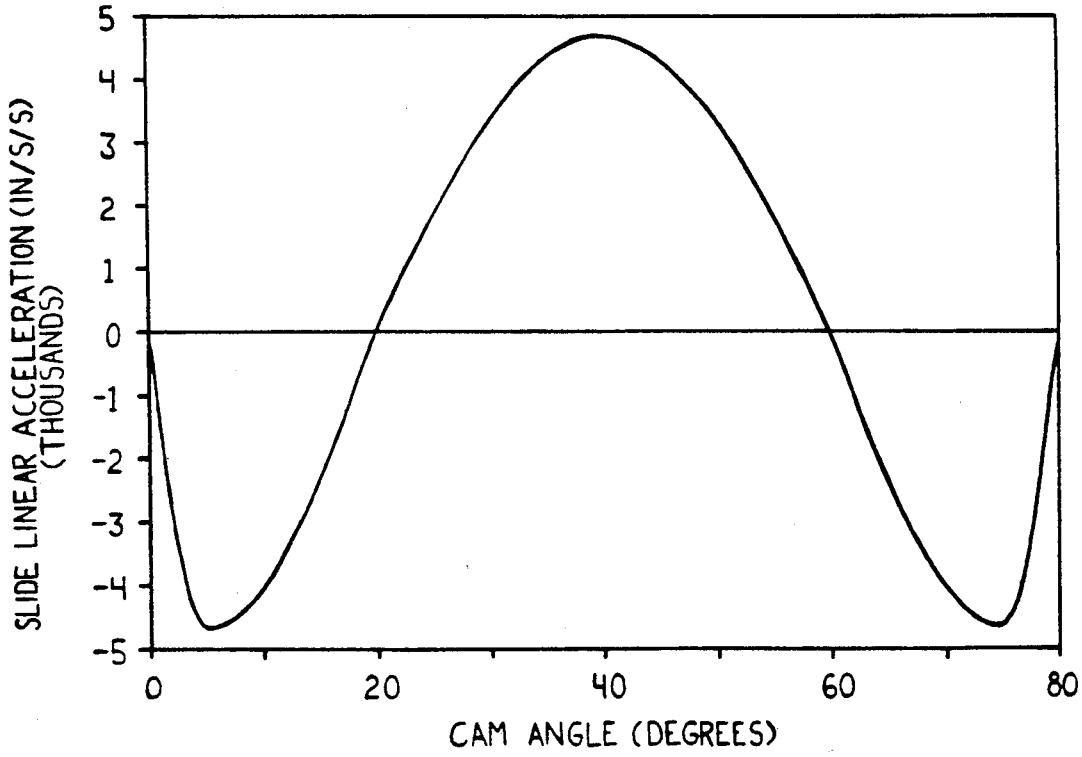
FIG. 8 is a graph of slider linear acceleration.

FIG. 6 represents the coupler angular velocity curve. The symmetry about the return-to-rise demarcation of 40° remains. Yet, the symmetry within the rise or return is tending to skew towards the transition from return to rise. The acceleration changes between the slider and coupler are more marked as seen in FIGS. 7 and 8. With respect to all the kinematic characteristics the continuity of the input motion is retained.

Figure 9:
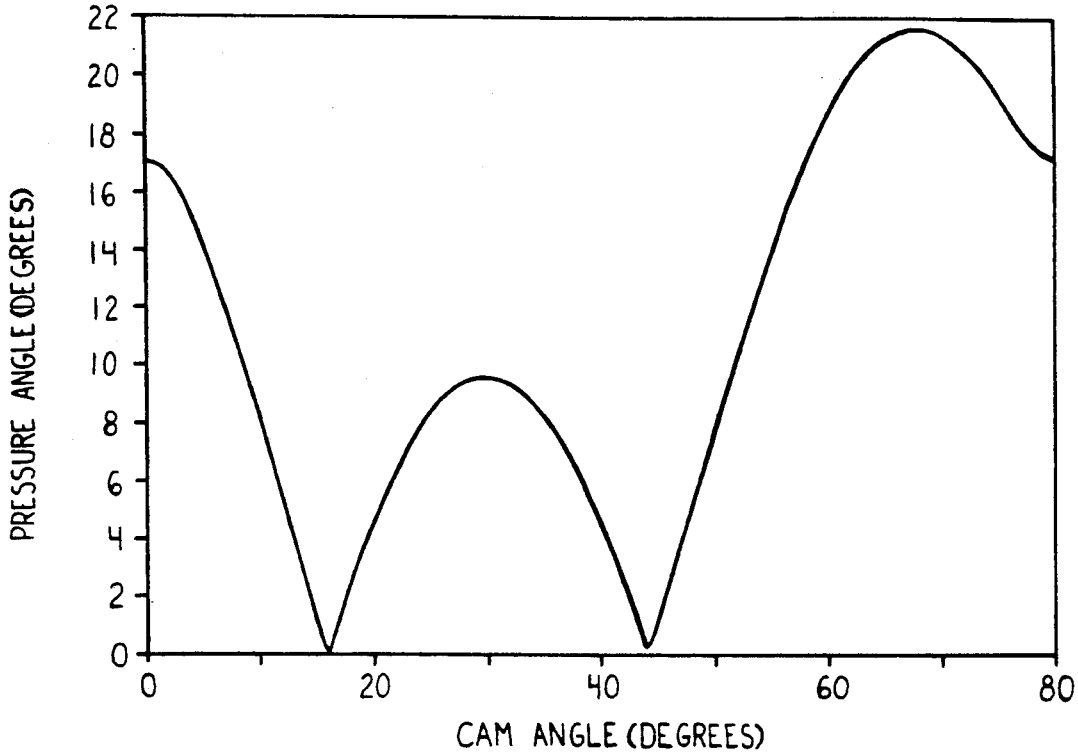
FIG. 9 is a graph of instantaneous cam pressure angle.

The instantaneous cam pressure angle is shown in FIG. 9. The pressure angle between the cam and the cam follower ranges from 17° to 42°, and the pressure angle changes from one side of the common normal to the other as described in the previous section at a 42° cam angle. The greater the pressure angle the greater the tangential load is transmitted to the bearings and cam to cam follower interface.

Figure 10:
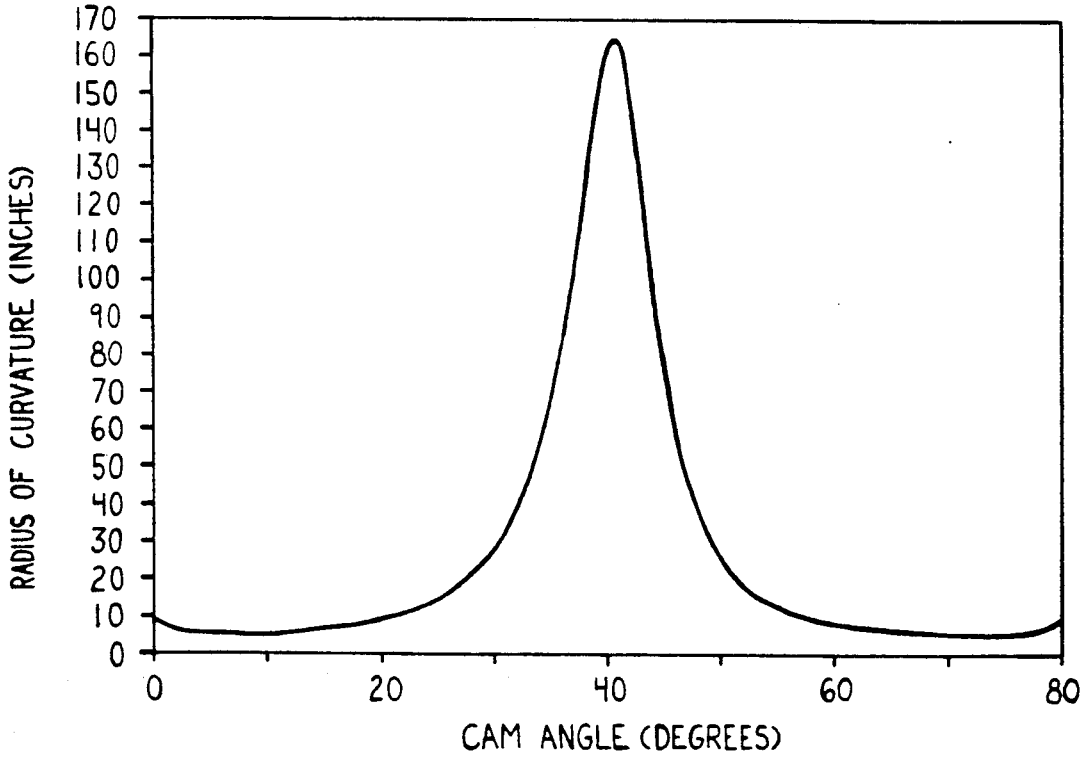
FIG. 10 is a graph of instantaneous cam radius of curvature.

The radius of curvature of the cam is also an instantaneous parameter as shown in FIG. 10. As the transition from the return to the rise is approached the radius increases. The greater the radius the lower the contact stresses.

Figure 11:
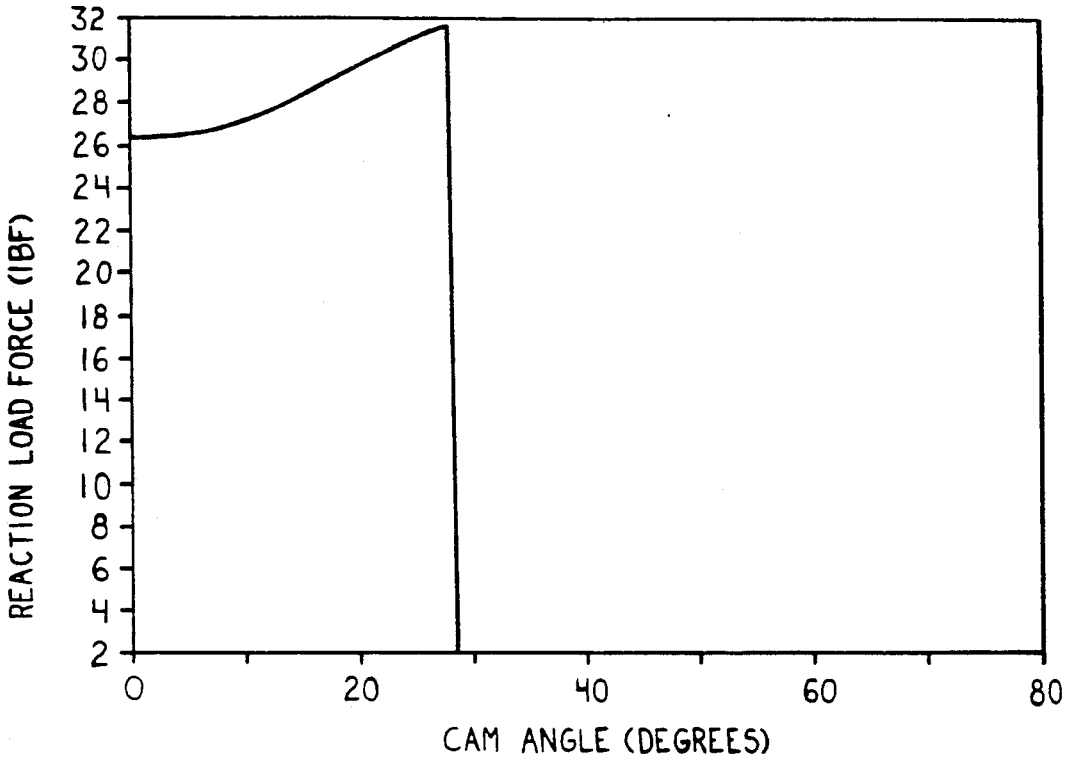
FIG. 11 is a graph of reaction load force.
Figure 12:
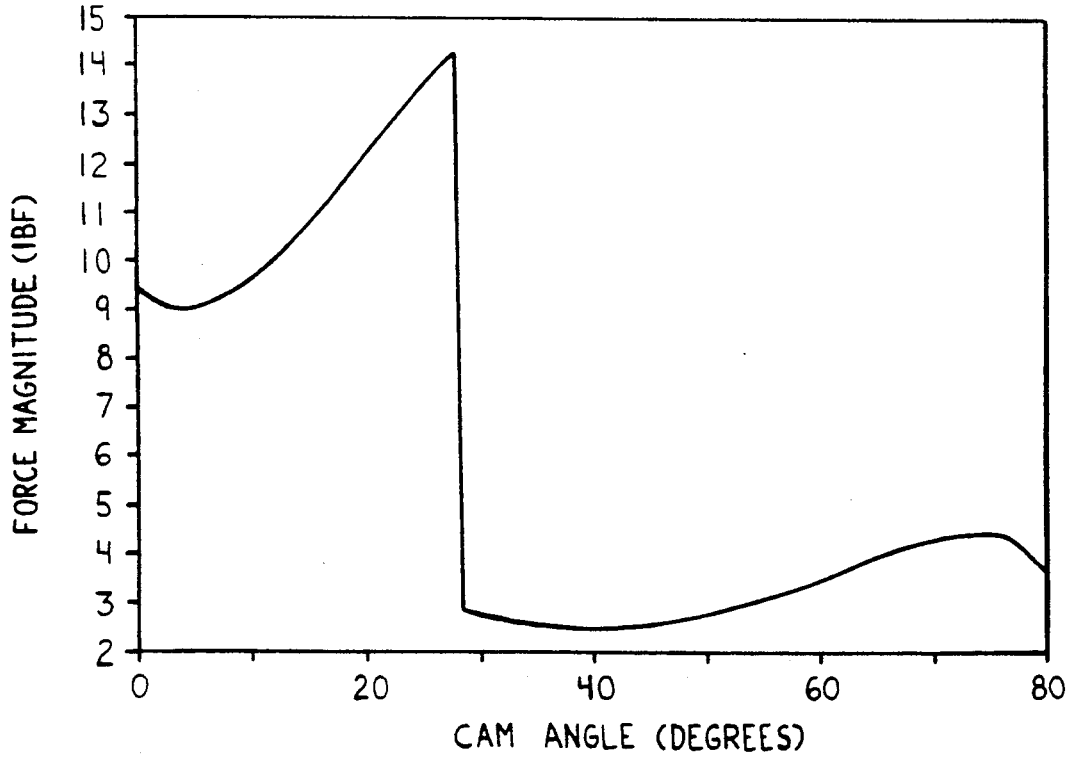
FIG. 12 is a graph of the magnitude of the force.

As part of the kinetic analysis, each reaction force is determined. FIGS. 11 and 12 represent the reaction loads at the slider cog and slider pivot respectively. Each shows the shape changes due to the acceleration profile and paper load. Once the paper is released, the step function is apparent and the dominant force is the acceleration profile. Next, the coupler is analyzed and the crank.

Figure 13:
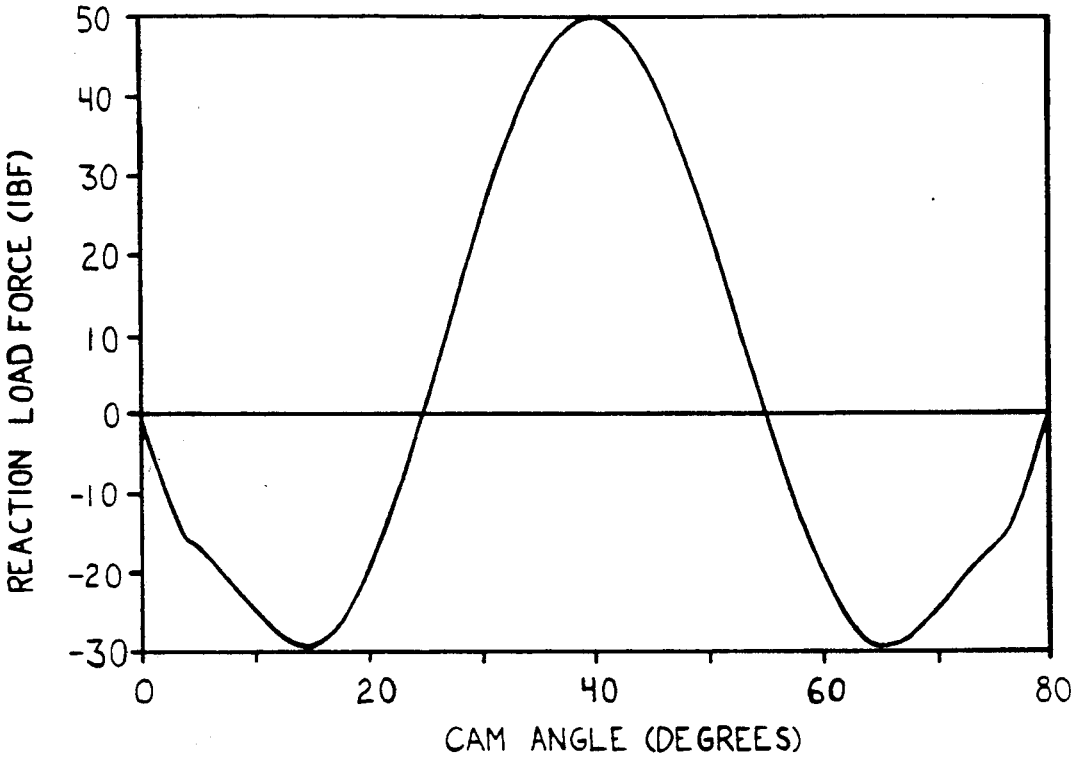
FIG. 13 is another graph of a reaction load force.
Figure 14:
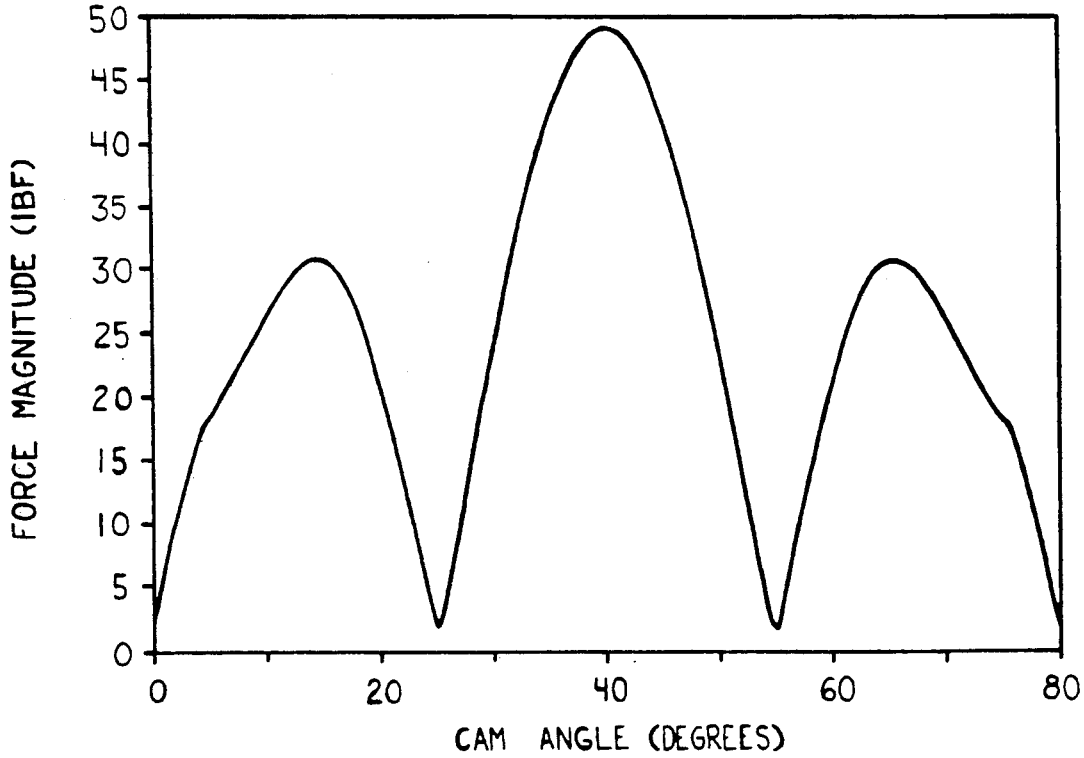
FIG. 14 is a graph of the force magnitude.

The coupler reaction forces are shown in FIGS. 13 and 14. FIG. 13 depicts, the curve for the absolute reaction force at the pin between the coupler and slider. This reaction force is collinear with the slider, therefore, the direction is parallel with the X-axis. The force at another pin, on the other hand is collinear with the crank.

Figure 15:
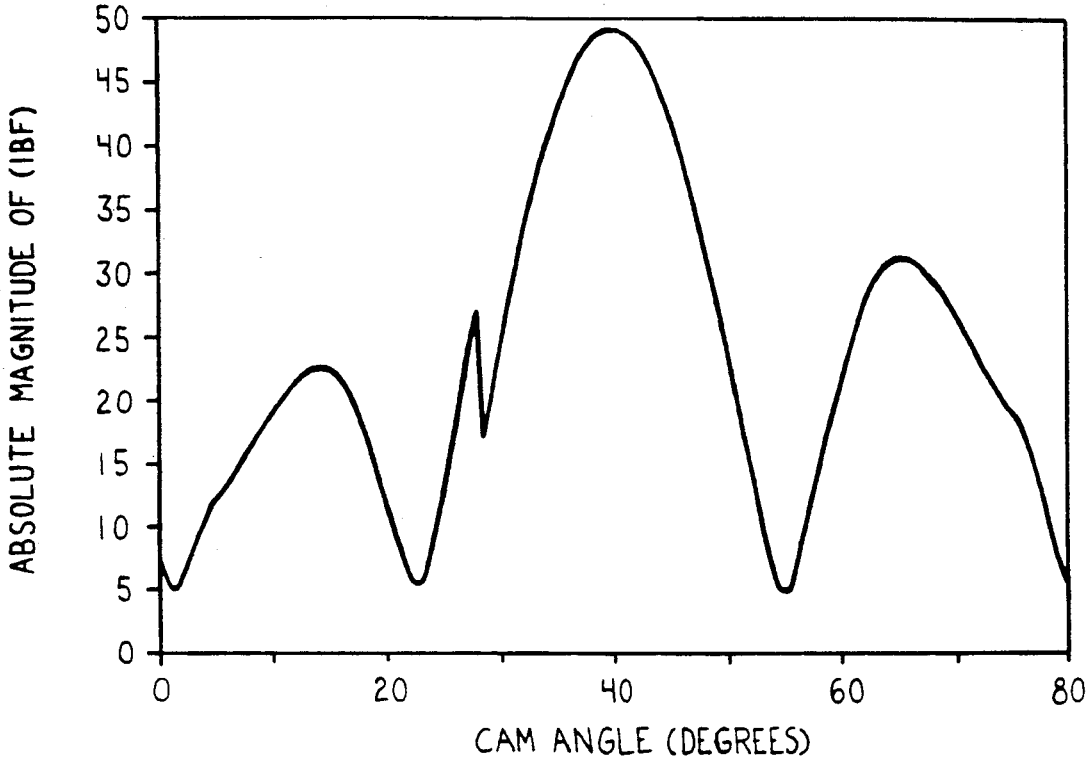
FIG. 15 is a graph of the absolute magnitude of force.

The absolute magnitude of the force is shown in FIG. 15. The principle of superposition is apparent as the dominant features of both the profile acceleration and paper load step are visible.

Figure 16:
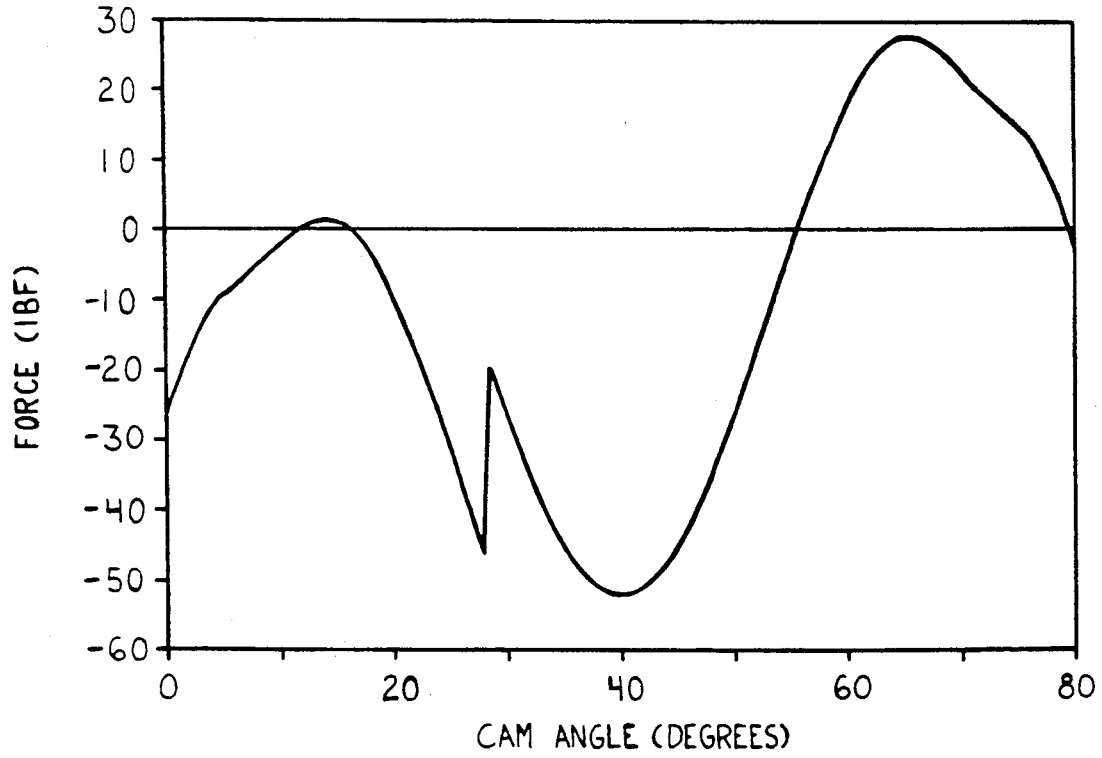
FIG. 16 is another graph of force.

FIG. 16 shows the torque as seen by the follower lever arm. The dominant acceleration profile force and the paper load are again apparent. The torque begins at 10 in-lb as credited to the paper load, and the remaining 50° show the modified sine-harmonic acceleration profile input.

Figure 17:
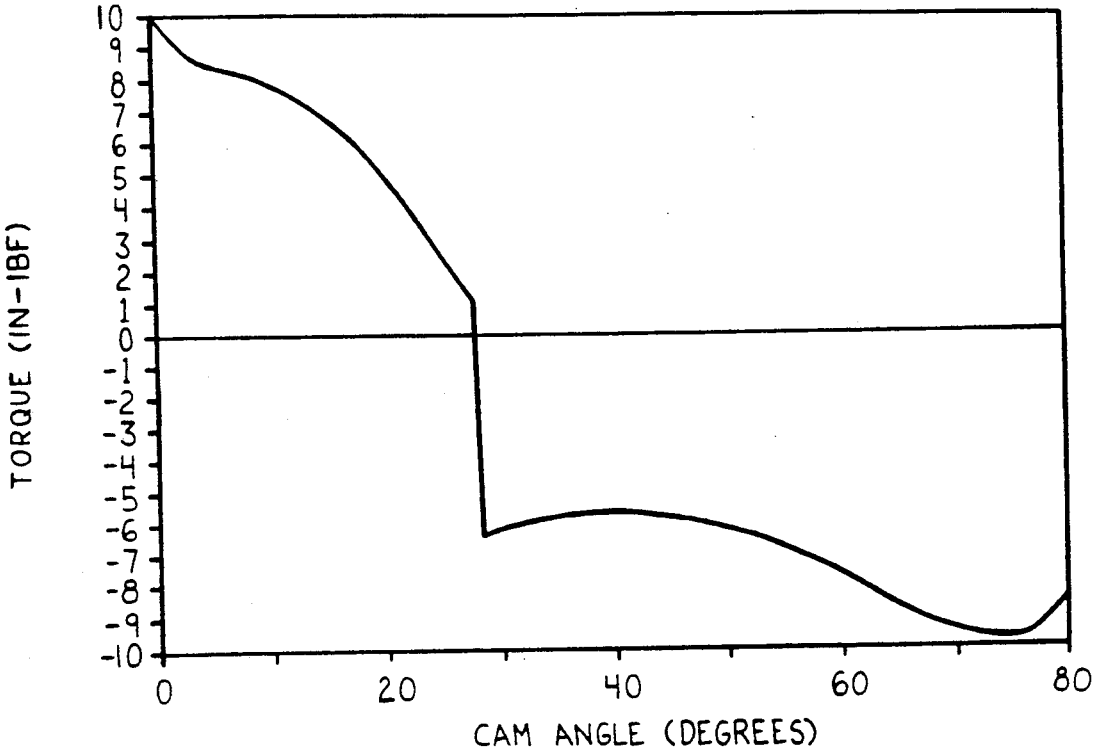
FIG. 17 is a graph of follower lever arm torque.

The normal load, used in determining the contact stress between the cam to cam follower interface is shown in FIG. 17. For the first time, the follower lever arm is considered with the roller follower. These two masses concurrent with the acceleration profile become the dominant forces in the normal load. The paper load is still apparent by the noticeable discontinuity at about 30°. The remaining torque effects are less noticeable in the slight skewness of the normal load shape.

Figure 18:
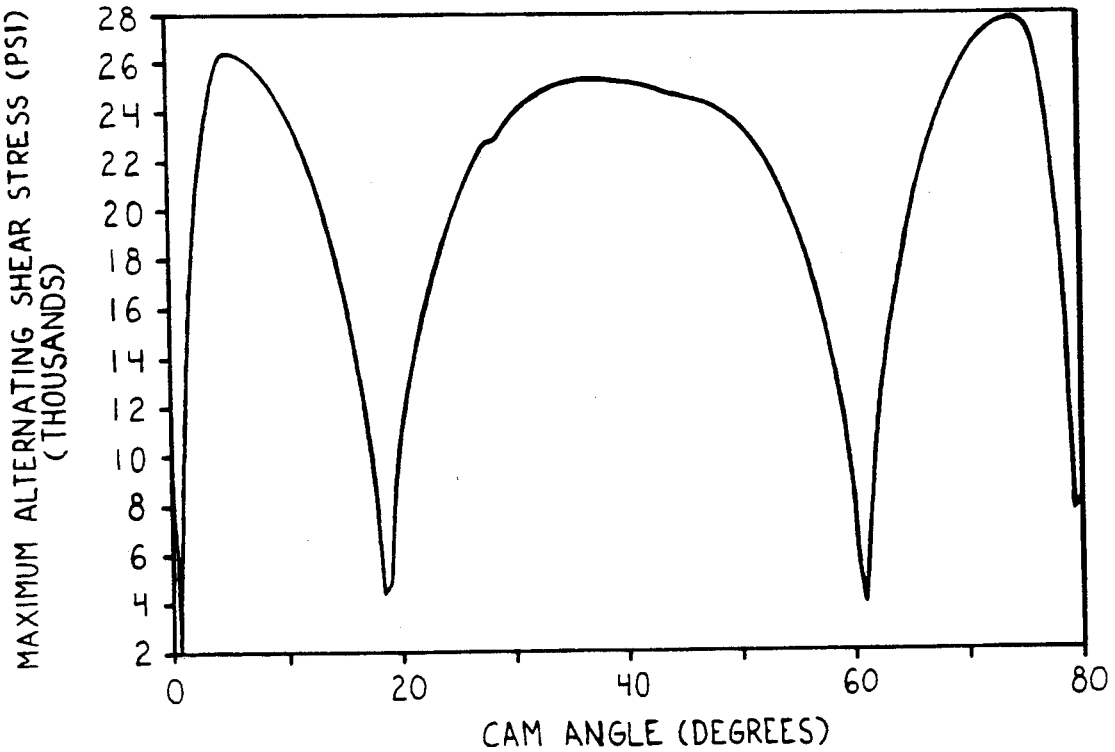
FIG. 18 is a graph of maximum alternating shear stress.
Figure 19:
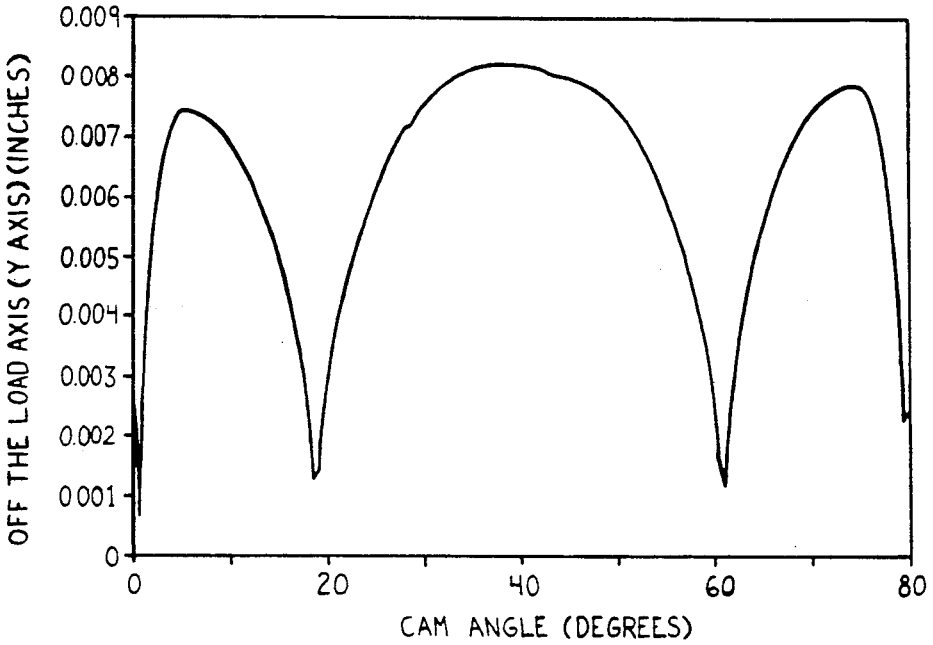
FIG. 19 is a graph of off-loading access dimension.
Figure 20:
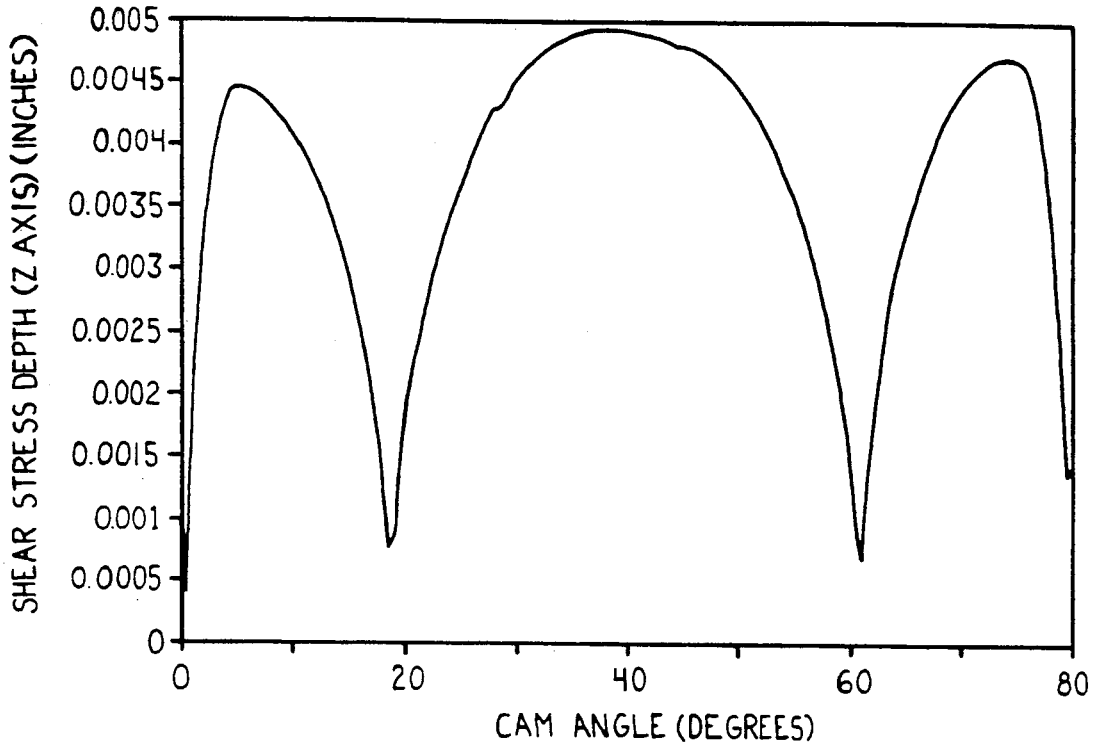
FIG. 20 is a graph of depth of alternating shear stress.

FIGS. 18, 19 and 20 represent the Hertzian contact parameters of comparison. These parameters are "maximum alternating shear stress", "off the load" and "depth of alternating shear stress". These last two values determine the physical, predicted location of the maximum alternating shear stress, at any instant along the profile. All three curves share the shape of the normal load curve.

In the evolution of the cam three parameters have changed. These are the total stroke, the total cam angle, and the cam motion profile itself. The effect of reducing the total stroke is a proportional reduction of motion profile acceleration. Increasing the total cam angle has the effect of reducing the motion profile acceleration by the inverse square function. The effect of changing motion profile is not so simple to evaluate.

In the present invention, a new cam profile was selected and the location of the applied motion profile was also changed from prior art approaches. In the past, the motion profile was applied to the roller follower, this was consistent across many industries. The desired motion is now applied to the output component, the pin.

The ultimate design goals are in essence to eliminate the two previously mentioned cam system problems. The goals are to protect the cam from the contaminated operating environment and reduce cam loads. The results of which will maintain the ability of the cam to transmit the desired motion profile under all operating modes.

Prior art folders were designed with the modified trapezoid motion profile. This profile was chosen for the low acceleration characteristics, and benefits over the trapezoid motion profile.

In the modified sine motion profile the curve is a combination of the cycloidal and harmonic curves. The change from positive to negative torque occurs in more than twice the travel time of the modified trapezoid curve; 0.42 compared to 0.20.

The modified sine-harmonic curve, replaces the third and fourth segments of the modified sine return with an additional harmonic. This harmonic ends with a positive acceleration. The modified sine-harmonic curve, then replaces the first and second segments of the modified sine rise with another harmonic which begins with a positive acceleration. The result is a continuous return-rise-dwell motion.

With respect to the modified sine-harmonics kinematics, the continuous acceleration characteristic during the transition from the return to rise profile, is a significant improvement over the modified trapezoid. See FIG. 18. Also, the jerk function needs to be considered. The modified sine-harmonic still retains a high jerk value at the beginning of the return and at the completion of the rise motion profiles. Again, though a significant improvement over the modified trapezoid motion profile.

Figure 21:
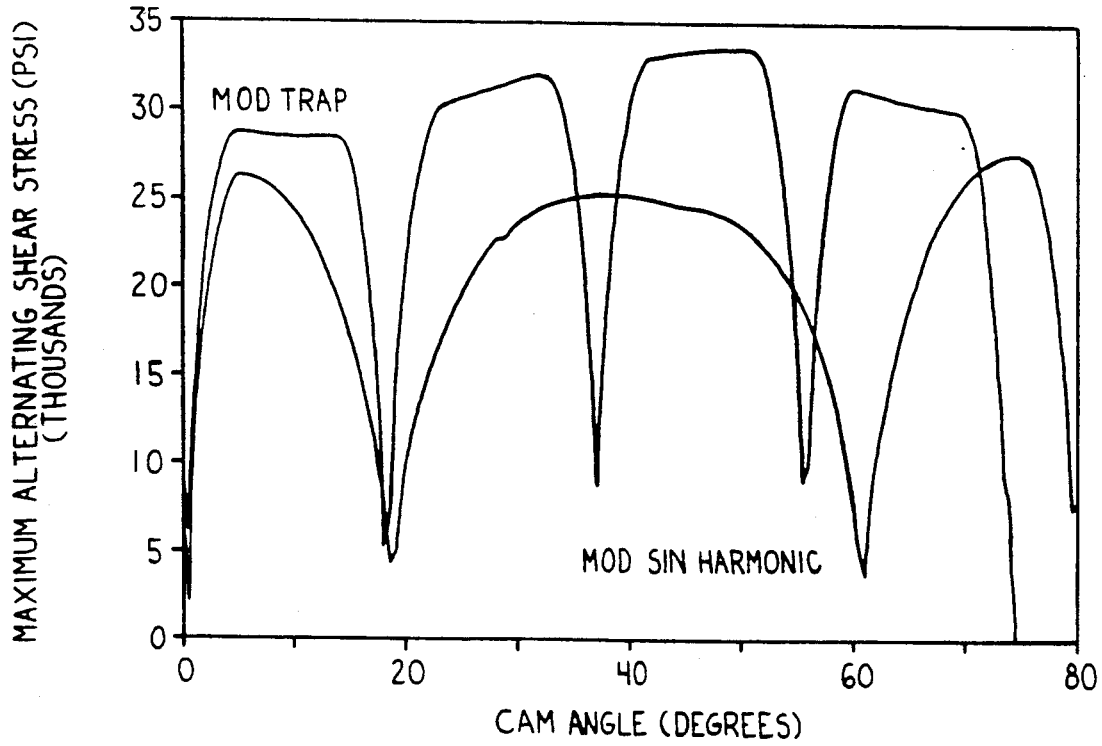
FIG. 21 is a graph of alternating shear stress comparison.
Figure 23A:
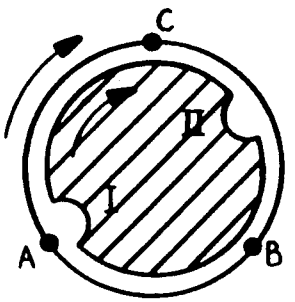
FIG. 23 is a schmatic depiction of the one-piece cam of the present invention in straight mode absolute motion.
Figure 23B:
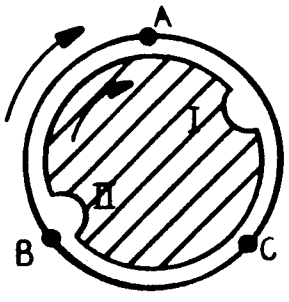
Figure 23C:
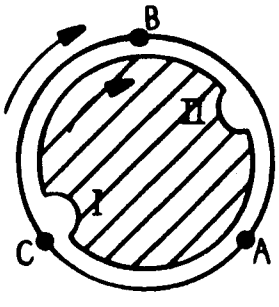
Figure 23D:
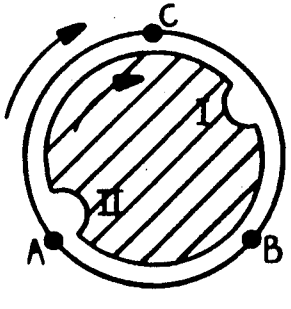

The benefits of the modified sine-harmonic are revealed in the comparison with the modified trapezoid, when considering the alternating shear stresses predicted. See FIG. 21. Another improvement over the modified trapezoid is that these maximum alternating shear stresses occur nearer the surface. This in turn allows the surface hardening techniques to be shallower and easier to attain.

For the modified sine-harmonic, surface fatigue, abrasive wear and adhesive wear can all be expected to decrease significantly in comparison with the modified trapezoid, thereby extending the effectiveness of the cam life.

With respect to the comparison of the modified sine-harmonic to the modified trapezoid motion profiles. The modified sine-harmonic cam preferably is constructed from tool steel as a replacement to the heat treated steel of the modified trapezoidal cam design. This is indicative of the two significant aspects of the present invention.

First, the level of stresses predicted require a surface hardness above the cast steel material properties. And secondly, the geometry of the prior art box cams does not allow enough clearance for conventional heat treating techniques.

The location of the stresses will appear at the beginning of the return and the end of the rise profile for two reasons. As the jerk profile shows, the maximum change of acceleration is at these locations. And again, the design feature inherited is the segmented cam. With the typical manufacturing techniques, and tolerances, once again steps can be expected. These steps will become more prevalent as contaminants fill the housing, as machinists change the lobes over and over.

Loads due to shock, (impact) can double or even triple (in high speed applications), above those predicted by acceleration profile curves.

Figure 22:
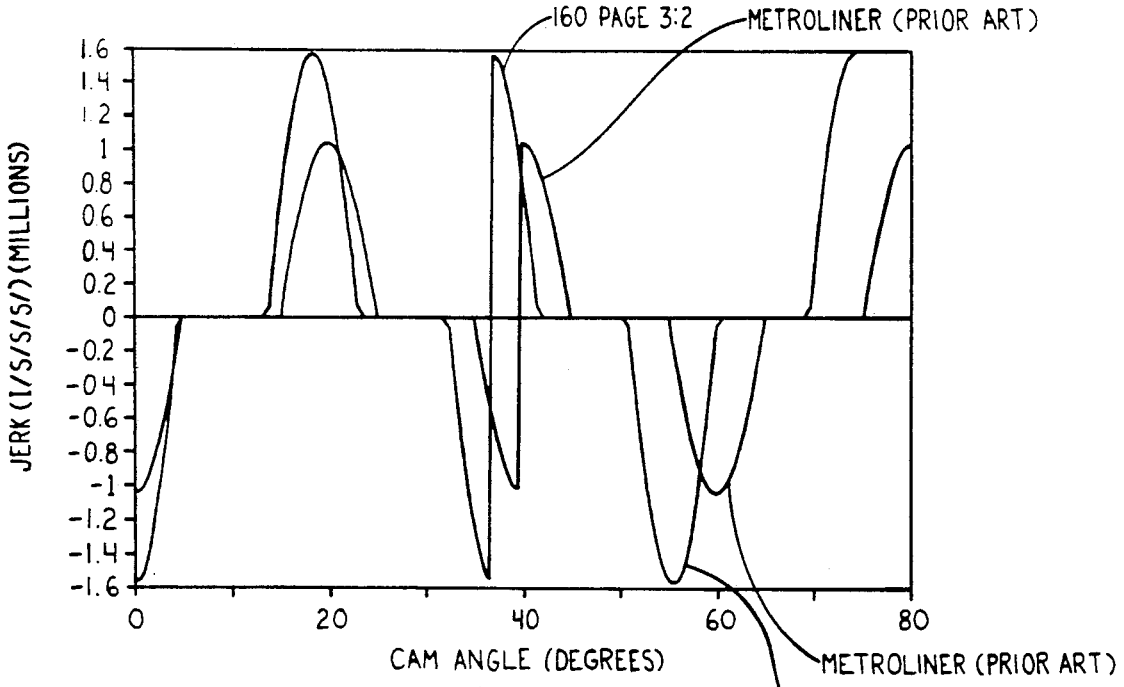
FIG. 22 is a graph of modified trapezoid jerk comparison.

Two conditions must be satisfied, to consider the loading of an impact. These are duration, and the transmitted energy. Considering the angular velocity of the cam and folding cylinders of the past, the changes in acceleration as seen in FIG. 22, occur in less than one-tenth of a second. Comparing the magnitude of the forces it becomes apparent that impact occurs at the cam interface.

Besides increased wear due to excessive stresses, forced vibrations are established as the box cam offers no damping. Therefore, it seems clear the cams have been exposed to the deteriorating affects of impacts, both increased loads and vibrations.

The prior art uses a symmetrical return to rise ratio in an effort to reduce cam loads. While this effectively reduces the rise loads, the return is unchanged from range of loads observed in the past. The wear concerns were addressed by changing the material of the cam. The specified material, is high-strength, flame hardened tool steel.

In the present invention, the uniqueness of the one-piece cam resides in the relative motion of the folding cylinder to the cam. The Straight mode of operation remains unchanged from current design, see FIG. 23. The cam and folding cylinder rotate in the same direction. Both continue to rotate at their original angular velocities, $\omega_{cam} > \omega_{foldingcyl}$ maintaining the same relative angular velocity. That is, for a single rotation of the folding cylinder, the cam rotates one and one-half times. The apparent motion of the folding cylinder to the cam is the folding cylinder moving from right to left past the cam, see FIG. 24.

The difference lies in the Collect mode of operation. The cam and folding cylinder continue to rotate in the same direction. The folding cylinder maintains its constant angular velocity. The cam now rotates at a reduced angular velocity, such that, $\omega_{cam} > \omega_{foldingcyl}$. The apparent motion of the folding cylinder to the cam is the folding cylinder moving from left to right past the cam, see FIGS. 25 and 26. Now, for a single rotation of the folding cylinder, the cam rotates three quarter times.

Figure 24:
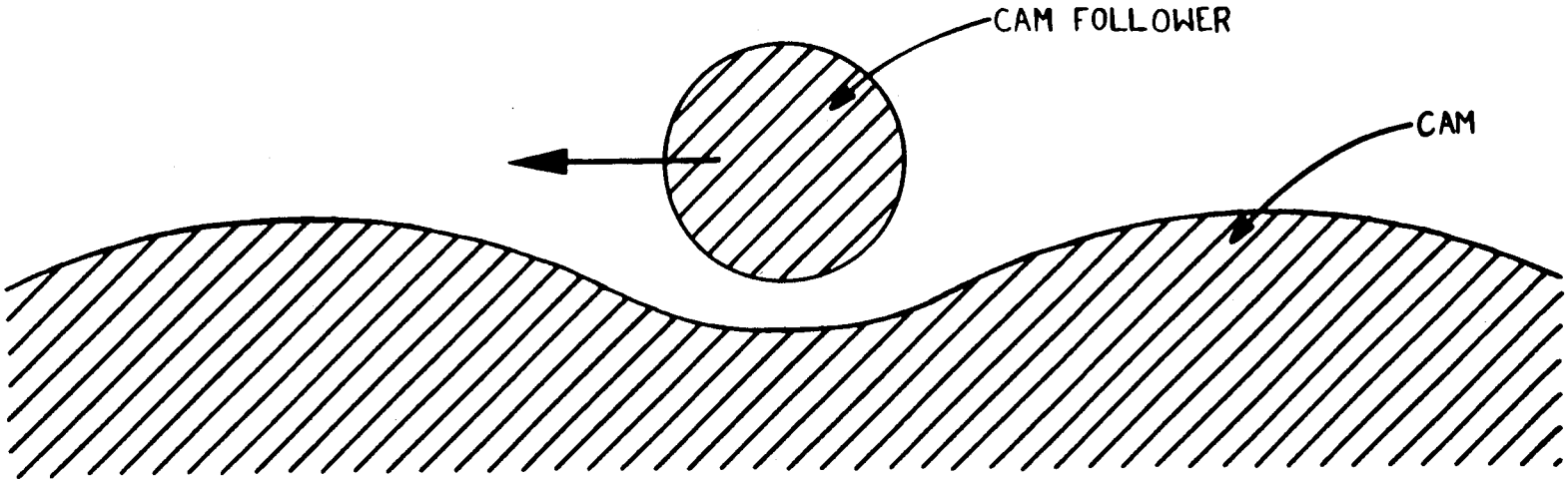
FIG. 24 is a depiction of one-piece cam straight mode relative motion.
Figure 25A:
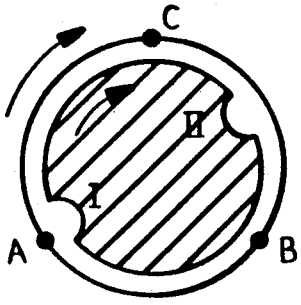
FIG. 25 is a schematic representation of the one-piece cam of the present invention in Collect mode absolute motion.
Figure 25B:
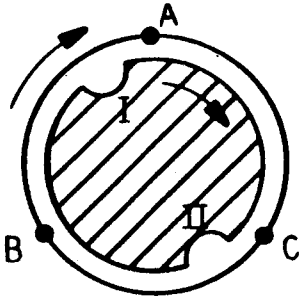
Figure 25C:
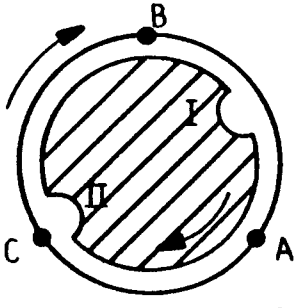
Figure 25D:
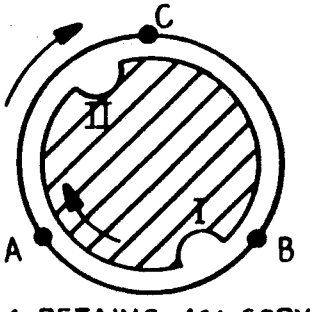
Figure 25E:
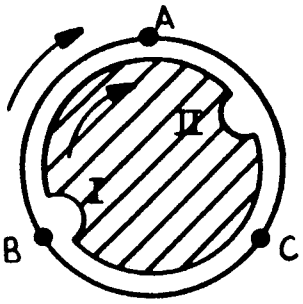
Figure 25F:
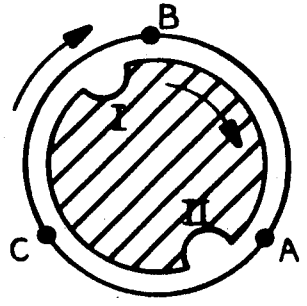
Figure 25G:
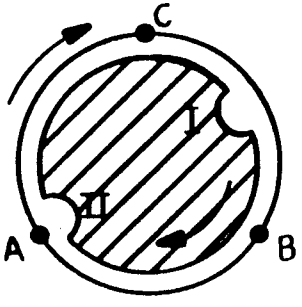
Figure 26:
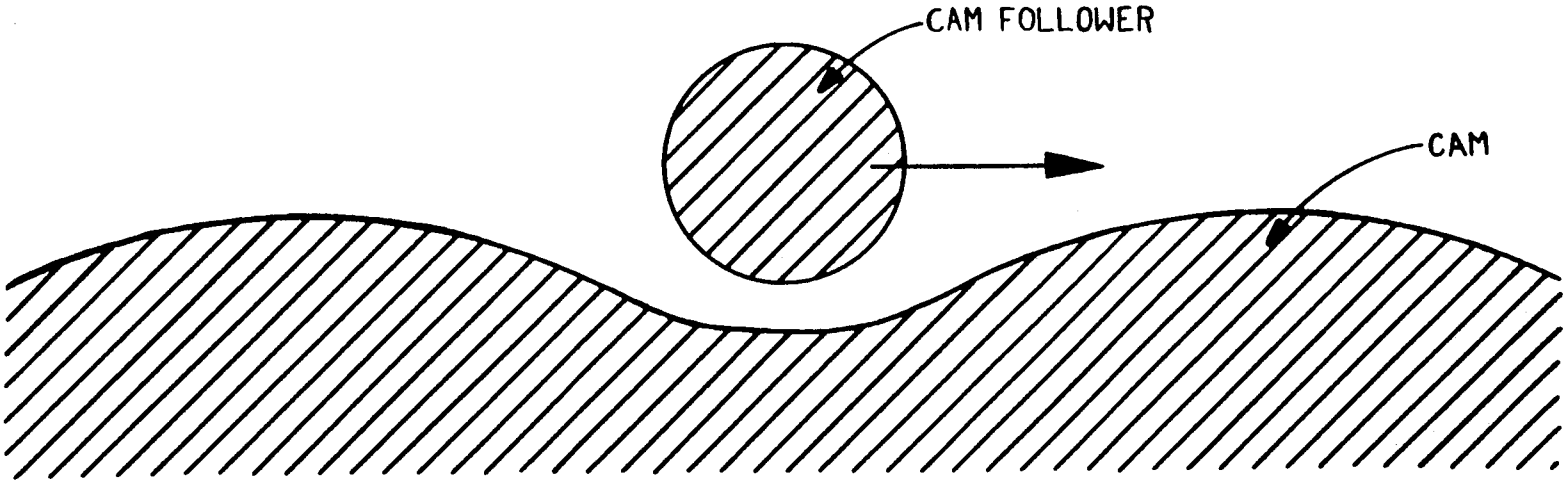
FIG. 26 is a schematic representation of one-piece cam collect mode relative motion.
Figure 27:
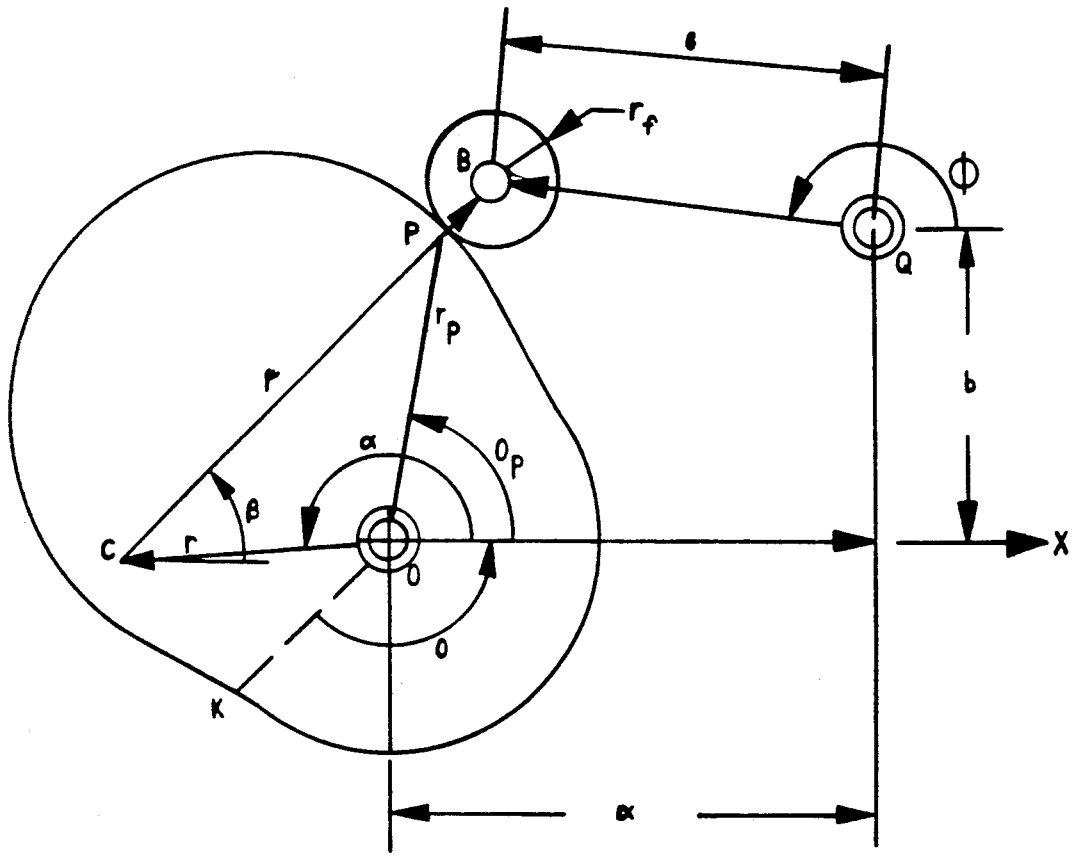
FIG. 27 is a depiction of the cam instantaneous radius of curvature.
Figure 28:
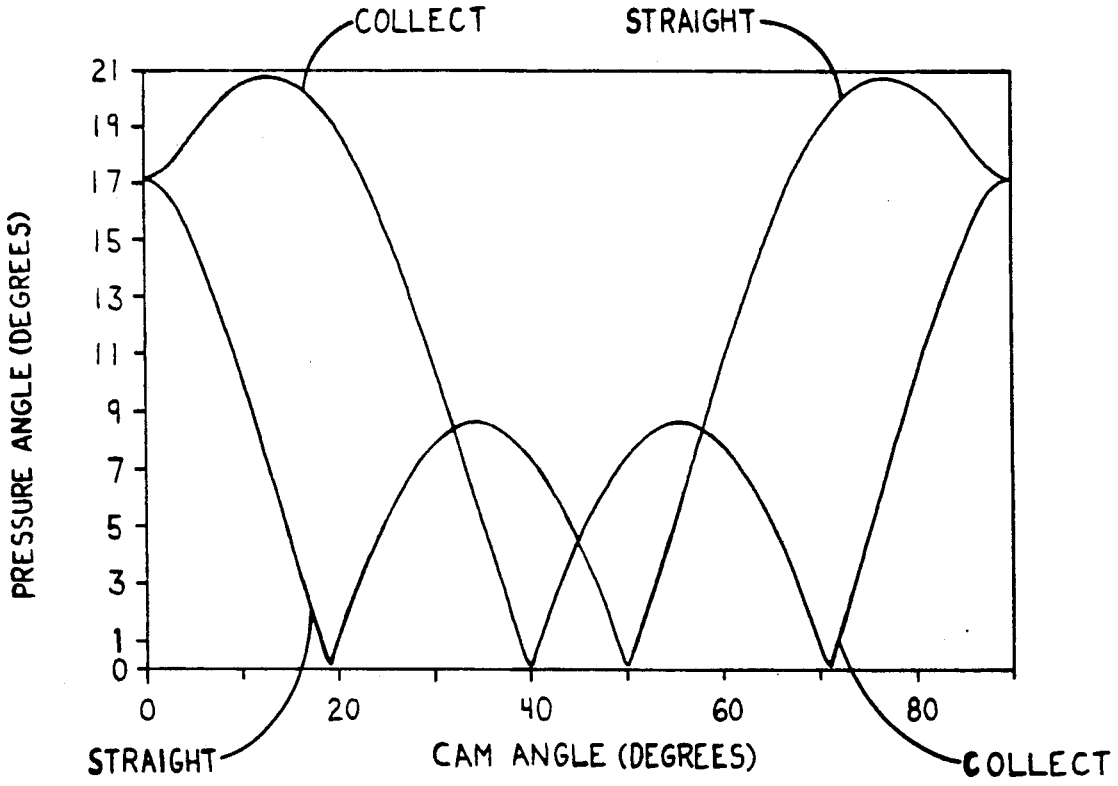
FIG. 28 is a graph of one-piece cam Straight verse Collect pressure angle.

The concern of using one cam for both the Straight and Collect modes of operation are two fold. First, the geometric relationship of the swinging roller follower to the cam, lends itself to a descriptive characteristic of 'trailing' or 'leading'. By viewing FIG. 27, and visualizing the relative motion of the cam follower to the cam as seen in FIGS. 24 and 26, the definitions are obvious. FIG. 28 shows the instantaneous pressure angle for both modes of operation. As can be seen, the relative direction of the follower to the cam is of no importance.

The second area of concern regards the change in relative constant angular velocity. Using the ratios given above, for a one-piece cam in a Straight run, for a single folding cylinder revolution, the dam rotates one and one-half times. This yields a delta angular velocity of one-half, this is the current relative angular velocity.

For the Collect run, the cam's angular velocity is reduced. Again using the ratio of a single folding cylinder rotation, the cam rotates only three-quarters of a rotation. Now the relative velocity is one-quarter. Therefore, the greatest loads will be observed during the Straight runs, which is the current constant relative velocity.

The one-piece cam design allows any motion profile selection. The current design applied the modified sine-harmonic profile using a symmetric return and rise of 45°. Use of a polynomial motion profile for a short increment could resolve the remaining jerk considerations.

The modified sine-harmonic motion profile eliminates an acceleration discontinuity and reduces the jerk at the rise-return transition.

The one-piece cam design satisfies both primary design goals. By removal of the segmented design, and application of the modified sine-harmonic motion profile, contamination in the system is reduced and excessive cam loading is greatly reduced. Also, the folding cylinder cam housing can be environmentally sealed. Primarily, the one-piece cam removes excessive loading at the segment seams. Additionally, the operational, and fabrication problems of the segmented cam are eliminated.

The invention is not limited to the particular details of the apparatus depicted and other modifications and applications are contemplated. Certain other changes may be made in the above described apparatus without departing from the true spirit and scope of the invention herein involved. It is intended, therefore, that the subject matter in the above depiction shall be interpreted as illustrative and not in a limiting sense.

What is claimed is

1. A folding cylinder assembly having at least first and second modes of operation, comprising:

rotatable folding cylinder having at least one pin lever shaft assembly, said pin lever shaft assembly having at least one pin and a cam follower positioned on a first end of the folding cylinder;

one piece cam for interfacing with said cam follower, said one piece cam rotationally mounted on said first end of said folding cylinder, said one piece cam having at least one lobe which periodically contacts said cam follower as said cam rotates;

means for rotating said folding cylinder and said cam such that said cam and said folding cylinder have a first relative angular velocity for the first mode of operation and a second relative angular velocity for the second mode of operation, the rotation of said cam imparting to said at least one pin on said pin lever shaft assembly via said cam follower a predetermined motion profile in both said first and second modes of operation, said predetermined motion profile being a modified sine-harmonic motion profile.

2. The folding cylinder assembly according to claim 1, wherein in the first mode of operation the folding cylinder rotates at a substantially constant angular velocity and the cam rotates at one and one-half times the substantially constant angular velocity in the same direction of rotation as the folding cylinder, and wherein in the second mode of operation the folding cylinder rotates at the substantially constant angular velocity and the cam rotates at three-quarters of the substantially constant angular velocity in the same direction of rotation as the folding cylinder.

3. The folding cylinder assembly according to claim 1, wherein in the first and second modes of operation the folding cylinder and the cam rotate in the same direction, and wherein in the first mode of operation the cam rotates at a greater angular velocity than the folding cylinder and in the second mode of operation the cam rotates at a lesser angular velocity than the folding cylinder.

4. The folding cylinder assembly according to claim 1, wherein said cam is formed of high strength, flame hardened steel.

5. The folding cylinder assembly according to claim 1, wherein the folding cylinder has three pin lever shaft assemblies spaced substantially equally about the folding cylinder, and wherein each of the cam followers of the pin lever shafts interface with said cam.

6. The folding cylinder assembly according to claim 1, wherein the first mode of operation is a Straight run mode and the second mode of operation is a Collect run mode.

7. A folding cylinder assembly having at least first and second modes of operation comprising:

rotatable folding cylinder having three pin lever shaft assemblies spaced substantially equally about the folding cylinder, each of said pin lever shaft assemblies having at least one pin and a cam follower positioned on a first end of the folding cylinder;

one piece cam for interfacing with said cam followers, said one piece cam rotationally mounted on said first end of said folding cylinder, said one piece cam having two lobes which periodically contact said cam followers as said cam rotates;

means for rotating said folding cylinder and said cam such that said cam and said folding cylinder have a first relative angular velocity for the first mode of operation and second relative velocity for the second mode of operation, wherein in the first mode of operation the folding cylinder rotates at a substantially constant angular velocity and the cam rotates at one and one-half times the substantially constant angular velocity in the same direction of rotation as the folding cylinder, and wherein in the second mode of operation the folding cylinder rotates at the substantially constant angular velocity and the cam rotates at three-quarters of the substantially constant angular velocity in the same direction of rotation as the folding cylinder, the rotation of said cam imparting to each of said at least one pin on said pin lever shaft assemblies via said cam followers, respectively, a predetermined motion profile in both said first and second modes of operation, said predetermined motion profile being a modified sine-harmonic motion profile.

8. The folding cylinder assembly according to claim 7, wherein said cam is formed of high strength, flame hardened steel.

9. The folding cylinder assembly according to claim 7, wherein the first mode of operation is a Straight run mode and the second mode of operation is a Collect run mode.

10. A folding cylinder assembly having at least first and second modes of operation, comprising:

rotatable folding cylinder having three pin lever shaft assemblies spaced substantially equally about the folding cylinder, each of said pin lever shaft assemblies having a plurality of pins and having a cam follower positioned on a first end of the folding cylinder;

one piece cam for interfacing with said cam followers, said one piece cam rotationally mounted on said first end of said folding cylinder, said one piece cam having two lobes which periodically contacts said cam followers as said cam rotates;

means for rotating said folding cylinder and said cam such that in the first and second modes of operation the folding cylinder and the cam rotate in the same direction, and such that in the first mode of operation the cam rotates at a greater angular velocity than the folding cylinder and in the second mode of operation the cam rotates at a lesser angular velocity than the folding cylinder, the rotation of said cam imparting to said plurality of pins on said pin lever shaft assemblies via said cam followers, respectively, a predetermined motion profile in both said first and second modes of operation said predetermined motion profile being a modified sine-harmonic motion profile.

11. The folding cylinder asembly according to claim 10, wherein in the first mode of operation the folding cylinder rotates at a substantially constant angular velocity and the cam rotates at one and one-half times the substantially constant angular velocity, and wherein in the second mode of operation the folding cylinder rotates at the substantially constant angular velocity and the cam rotates at three-quarters of the substantially constant angular velocity.

12. The folding cylinder assembly according to claim 10, wherein said cam is formed of high strength, flame hardened steel.

13. The folding cylinder assembly according to claim 10, wherein the first mode of operation is a Straight run mode and the second mode of operation is a Collect run mode.

* * * * *